US006356726B1

(12) United States Patent
Campbell et al.

(10) Patent No.: US 6,356,726 B1
(45) Date of Patent: Mar. 12, 2002

(54) ELECTROPHOTOGRAPHIC PRINTER WITH COMPACT PRE-TRANSFER ERASE ASSEMBLY

(75) Inventors: Alan Stirling Campbell; Gary Allen Denton; Gregory Lawrence Ream, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/594,871

(22) Filed: Jun. 15, 2000

(51) Int. Cl.[7] ..... G03G 21/00
(52) U.S. Cl. ..... 399/128; 399/107
(58) Field of Search ..... 399/66, 127, 128, 399/156, 296, 302, 308, 92, 107, 111; 362/31, 230, 231, 800

(56) References Cited

U.S. PATENT DOCUMENTS 4,025,180 A * 5/1977 Kurita et al. ..... 399/92
4,077,711 A 3/1978 Akamatsu
4,342,511 A 8/1982 Routt, Jr. et al.
4,779,166 A * 10/1988 Tanaka et al. ..... 362/31
4,843,427 A 6/1989 Ibuchi
5,214,536 A 5/1993 Prakash
5,255,171 A * 10/1993 Clark ..... 362/231
5,506,662 A 4/1996 Morihara
5,559,580 A 9/1996 Niizawa et al.
5,575,549 A 11/1996 Ishikawa et al.
5,604,571 A 2/1997 Kato et al.
5,664,862 A 9/1997 Redmond et al.
5,709,447 A 1/1998 Murakami et al.
5,808,650 A 9/1998 Akao
5,810,463 A 9/1998 Kawahara et al.
5,835,814 A 11/1998 Sawada
5,966,560 A * 10/1999 Kodama et al. ..... 399/66
6,026,269 A * 2/2000 Setoriyama ..... 399/302

* cited by examiner

*Primary Examiner*—Sophia S. Chen
*Assistant Examiner*—Hoan Tran
(74) *Attorney, Agent, or Firm*—John Victor Pezdek; Michael T. Sanderson; Todd T. Taylor

(57) ABSTRACT

An electrophotographic image forming apparatus includes a photoconductive drum and a transfer roll-positioned adjacent to and defining a nip with the drum. An image substrate travels through the nip in an advance direction. A toner cartridge assembly is positioned in association with the drum and above the image substrate. A pre-transfer erase assembly having a light emitting outlet is positioned between the toner cartridge assembly and the image substrate. The light emitting outlet is directed toward the drum.

26 Claims, 3 Drawing Sheets

ELECTROPHOTOGRAPHIC PRINTER WITH COMPACT PRE-TRANSFER ERASE ASSEMBLY

BACKGROUND OF THE INVENTION

1. Field of the Invention

The present invention relates to an electrophotographic imaging apparatus such as a laser printer, and, more particularly, to an electrophotographic imaging apparatus including a pre-transfer erase assembly.

2. Description of the Related Art

An electrophotographic (EP) imaging apparatus such as a laser printer includes one or more transfer stations at which a different color toner is transferred to an image substrate. A mono-color laser printer typically includes a single transfer station, and a multi-color laser printer typically includes multiple transfer stations. In the case of a tri-color laser printer, it is known to provide four transfer stations, with each transfer station having a toner cartridge assembly carrying cyan, magenta, yellow or black toner.

It is also known to provide an image substrate in the form of an intermediate transfer member (ITM) such as an intermediate transfer belt to which the developed image is transferred. For example, the Lexmark Optra Color 1200 laser printers sold by the assignee of the present invention include four toner cartridge assemblies which are sequentially positioned along a substrate path defined by a media transport belt. Colored toner is sequentially developed onto selected dot locations of the latent image on each photoconductor drum that is associated with each cartridge thereby rendering visible a color latent image. Each transfer station causes a respective developed color toner image to transfer to and accumulate upon the transported medium. The composite developed and transferred color image is then fused using a fuser assembly.

It is known to provide a pre-transfer erase assembly within each transfer station prior to the latent image being transferred from the PC drum to the image substrate. For example, it is known to provide a transparent intermediate transfer belt and a Light Emitting Diode (LED) array positioned on a side of the ITM belt opposite from the PC drum. Light from the LED array shines through the ITM belt and partially discharges the PC drum. A pre-transfer erase assembly reduces the magnitude of electrostatic fringe fields holding toner onto the drum, thereby making more toner available for transfer to the print media. Moreover, the pre-transfer erase assembly reduces the voltage difference between the transfer roll/intervening media and the charge areas of the PC drum, thereby decreasing the likelihood of air ionization both pre-nip and post-nip. Reduction in the voltage differential reduces voiding and toner scatter which otherwise can result from air ionization.

A problem with a pre-transfer erase assembly as described above is that often times there is not sufficient space available within the printer to allow for use thereof. It is desirable to maintain the overall size of a printer as small as possible. With a multi-color printer, it is thus common to position four separate toner cartridge assemblies within tight geometric constraints. The limited space available heretofore has limited the use of pre-transfer erase assemblies.

What is needed in the art is a pre-transfer erase assembly for use in an electrophotographic printer which accommodates tight geometric constraints while at the same time providing sufficient illumination of the PC drum.

SUMMARY OF THE INVENTION

The present invention provides an electrophotographic image forming apparatus having a pre-transfer erase assembly which is carried by the frame of the image forming apparatus and positioned between a toner cartridge assembly and image substrate to illuminate a PC drum.

The invention comprises, in one form thereof, an electrophotographic image forming apparatus including a photoconductive drum and a transfer roll positioned adjacent to and defining a nip with the drum. An image substrate travels through the nip in an advance direction. A toner cartridge assembly is positioned in association with the drum and above the image substrate. A pre-transfer erase assembly having a light emitting outlet is positioned between the toner cartridge assembly and the image substrate. The light emitting outlet is directed toward the drum.

An advantage of the present invention is that the pre-transfer erase assembly may be used in conjunction with a transfer station having tight geometric constraints.

Another advantage is that the pre-transfer erase assembly is at least partially positioned in the space between the toner cartridge assembly and the image substrate.

Yet another advantage is that the light from the pre-transfer erase assembly may be selectively projected at different angles and varying areas of the PC drum.

A still further advantage is that different types of lights may be used with the light pipe and light guide.

Yet another advantage is that the light pipe and/or light guide may be formed as a hollow or solid body.

A further advantage is that when constructed as a solid body, the light pipe and/or light guide may include a fluorescent dye therein for receiving light at one wavelength and emitting light at a different wavelength.

Another advantage is that the light pipe and light guide may be mounted to and carried by the frame or toner cartridge assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
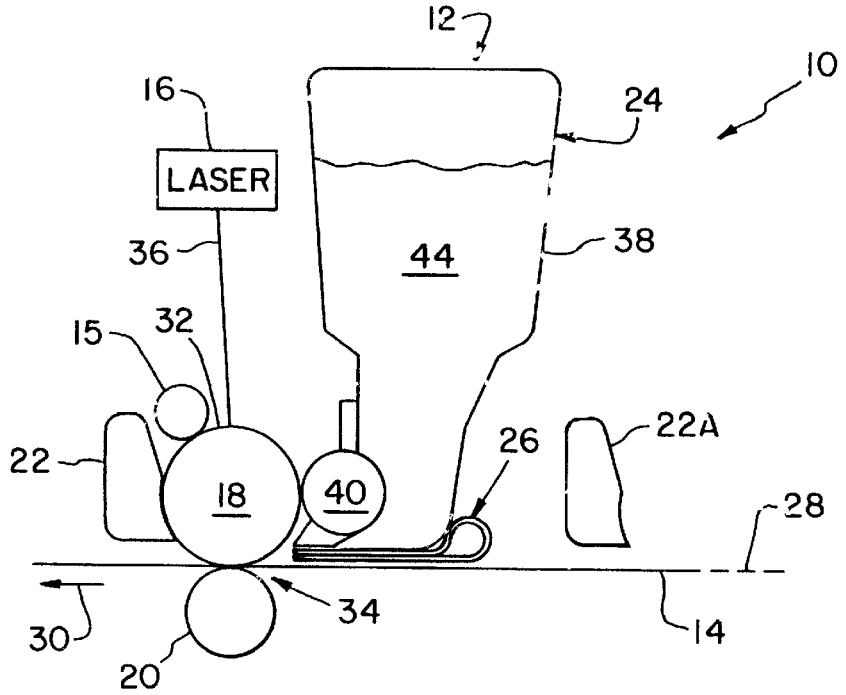
FIG. 1 is a simplified, side view of a portion of an electrophotographic imaging apparatus of the present invention.
Figure 2:
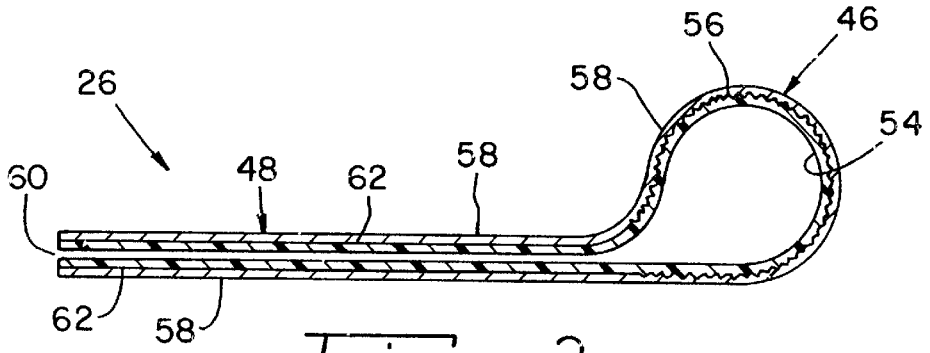
FIG. 2 is an end view of the light pipe and integral light guide of the pre-transfer erase assembly shown in FIG. 1.
Figure 3:
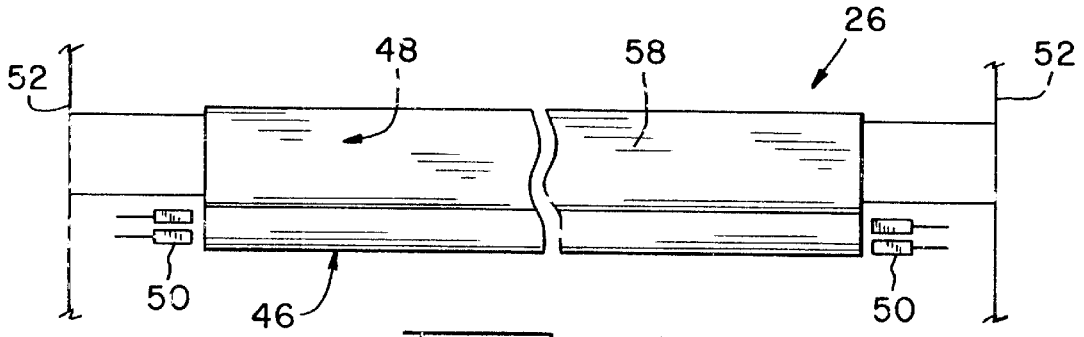
FIG. 3 is a top view of the pre-transfer erase assembly shown in FIGS. 1 and 2.

Referring now to the drawings, and more particularly to FIGS. 1–3, there is shown an embodiment of an EP image forming apparatus 10 of the present invention. In the embodiment shown, EP image forming apparatus 10 is in the form of a multi-color image forming apparatus with a plurality of imaging stations 12. Each imaging station 12 is associated with a respective color toner which is applied to image substrate 14. Each imaging station 12 generally includes a laser 16, PC drum 18, transfer roll 20, cleaner 22, toner cartridge assembly 24, and pre-transfer erase assembly 26. Each imaging station 12 is sequentially arranged along a substrate path 28 aligned generally coincident with image substrate 14 moving in advance direction 30. For purposes of simplicity and ease of illustration, a single imaging station 12 is shown in FIG. 1 with respect to a cleaner 22A of an adjacent imaging station (only partially illustrated) located upstream therefrom, with respect to advance direction 30.

Laser 16 scans a laser beam 36 in a scan direction (perpendicular to the drawing of FIG. 1) across PC drum 18 at selected locations within a scan line. Laser 16 may be configured in a conventional manner, such as with a laser source, rotating polygonal mirror, fold mirrors, lenses, etc. For ease of illustration and description, laser 16 is shown schematically in FIG. 1.

PC drum 18 also may be of known construction, and includes a PC outer surface 32 on which a latent image is formed. Transfer roll 20 is positioned adjacent to PC drum 18 and defines a nip there between. Image substrate 14 travels within substrate path 28 through transfer nip 34.

Cleaner 22 is used to remove toner particles from outer surface 32 of PC drum 18 and thereby clean PC drum 18 prior to charging by charge roll 15 and exposure from a scanned laser beam 36 generated by laser 16.

Toner cartridge assembly 24 includes a housing 38 and developer roll 40. Toner 44 of a predetermined color is carried within housing 38 and is applied to PC drum 18 at selected locations in known manner.

Image substrate 14 receives an image corresponding to the latent image formed on PC drum 18 that is rendered visible by color toner at developer roll 40. Image substrate 14 may be in the form of a print medium transported upon an associated transport belt or an ITM such as an intermediate transfer belt. In the embodiment shown, image substrate 14 is assumed to be an intermediate transfer belt which carries the developed image to a nip located downstream for transfer to a print medium. Each imaging station 12 applies a different color toner carried within a corresponding toner cartridge assembly 24 to intermediate transfer belt 14 in a sequential manner within a common image area to develop the multi-color image on intermediate transfer belt 14.

Pre-transfer erase assembly 26, shown in more detail in FIGS. 2 and 3, includes a light pipe 46, light guide 48 and one or more source lights 50. Pre-transfer erase assembly 26, in the embodiment shown, is carried by frame 52 of EP image forming apparatus 10 as shown in FIG. 3. However, pre-transfer erase assembly 26 may also optionally be carried by an associated toner cartridge assembly 24. Light pipe 46 is formed as a hollow pipe having an inner surface 54 and outer surface 56. Light pipe 46 as well as light guide 48 are each formed from a clear, translucent or opaque plastic which allows light within light pipe 46 to pass there through. Outer surface 56 is roughened or textured to scatter light within light pipe 46. A reflective coating 58 is applied to roughened outer surface 56 to reflect and scatter light within light pipe 46. In the embodiment shown, reflective coating 58 is in the form of reflective paint; however, reflective coating 58 may be of any suitable reflecting material, such as vacuum deposited metal, sputtered metal, plated metal, etc.

Light guide 48 is attached to and extends from light pipe 46. In the embodiment shown, light guide 48 is monolithically formed with light pipe 46, and includes a slot-shaped light-emitting outlet opening 60 from which light exits. Outlet opening 60 is positioned at a predetermined distance away from outer surface 32 of PC drum 18. Outlet opening 60 may be configured to transmit light against PC drum 18 in a direction generally parallel to advance direction 30, as illustrated in FIGS. 1 and 2. Alternatively, outlet opening 60 may be configured to transmit light against PC drum 18 at a different predetermined angle relative to substrate path 28 and advance direction 30. For example, outlet opening 60 may be tapered, angled and/or curved to transmit light against PC drum 18 at a predetermined angle. Alternatively, light guide 48 may include a lens (not shown) at outlet opening 60 to direct and/or diffuse light in a predetermined manner against PC drum 18. In the embodiment shown in FIGS. 1–3, light guide 48 is substantially plate-shaped and defines a slot-shaped outlet opening 60 which communicates with the interior of light pipe 46. Light guide 48 includes an outer surface 62 to which a reflective coating 58 is applied, such as reflective paint, etc. as described above. Outer surface 62 may also optionally be configured with a roughened surface to reflect and diffuse light.

Of course, forming a roughened surface on outer surface 56 assumes that light pipe 46 is formed from a transparent material such as transparent plastic. If light pipe 46 is formed from a non-transparent material, the roughened surface and/or reflective coating 58 may be applied to inner surface 54. In the embodiment shown, outer surface 56 is roughened and reflective coating 58 is applied thereover for manufacturing purposes. Light pipe 46 may also be formed from a white, high reflectivity plastic like polystyrene loaded with 7.5–10% Ti $O_2$; thus, not requiring painting or coating.

Lights 50 are configured to provide adequate light within light pipe 46 and light guide 48 to transmit light with a predetermined energy level against PC drum 18. For example, each light 50 may be configured as an LED, laser diode, incandescent lamp, etc. In the embodiment shown, lights 50 are in the form of a pair of LED's at each longitudinal end of light pipe 46. Alternatively, a single pair of LED's 50 may be placed at one end of light pipe 46, with the opposite end being covered with a reflective material. When two Lite-On Corporation double diffused AlGaS LTL3262WC super-bright Red LED's are used, a light source intensity of nominally 1000 micro-watts ($\mu$W) at 660 nanometer (nM) generates approximately 50 $\mu$W of radiant energy at PC drum 18 corresponding to a light pipe/light guide optical efficiency of about 5%. At a 22.75 centimeter length of light pipe 46 and light guide 48, and a process speed of image substrate 14 of about 11 centimeters per second, this results in 0.2 micro-joules per centimeter squared ($\mu J/cm^2$) exposure energy at PC drum 18 which is a nominal requirement for pre-transfer erase. This yields a 39% discharge of outer surface 32 of PC drum 18 which has l/e sensitivity of 0.4 $\mu J/cm^2$.

If a higher light energy level is required for pre-transfer erase of PC drum 18, one or more lights 50 may be configured as a laser diode generating a light source intensity of about 5000 $\mu$W. A bright, incandescent lamp may also be utilized and controllably actuated, but has the disadvantage of slow turn-on and turn-off times associated therewith.

In the embodiment of pre-transfer erase assembly 26 shown in FIGS. 1–3, the distance from PC drum 18 to the back of housing 38 of toner cartridge assembly 24 is approximately 38 millimeters. Moreover, the distance between the bottom of housing 38 and the top of image substrate 14 is approximately 3 millimeters. Light guide 48 is approximately 1 millimeter thick and 35 millimeters wide (parallel to image substrate 14). Light pipe 46 is positioned adjacent to the rear of housing 38.

Figure 4:
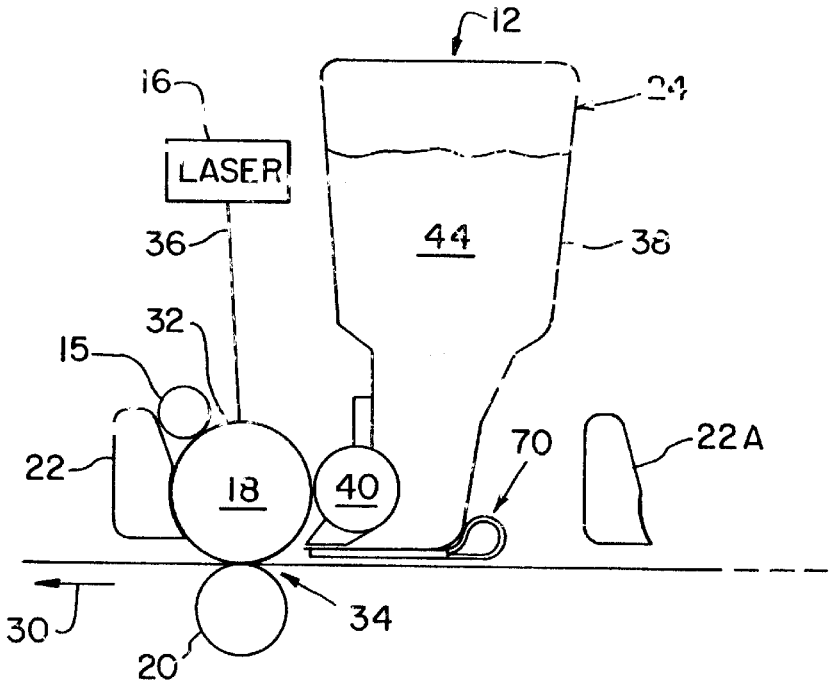
FIG. 4 is a simplified, side view of a portion of another embodiment of an electrophotographic imaging apparatus of the present invention.
Figure 5:
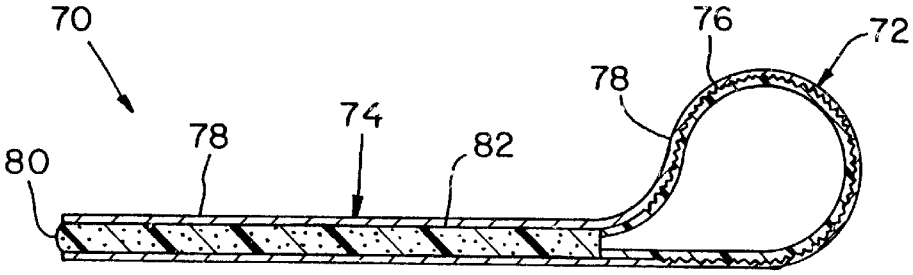
FIG. 5 is an end view of the light pipe and integral light guide of the pre-transfer erase assembly shown in FIG. 4.

FIGS. 4 and 5 illustrate another embodiment of a pre-transfer erase assembly 70 of the present invention. Pre-transfer erase assembly 70 also includes a light pipe 72 and a light guide 74. Light guide 74 is attached to and extends from light pipe 72. Light pipe 72 is formed as a hollow pipe from a transparent plastic. Light pipe 72 includes a roughened outer surface 76 and reflective coating 78, similar to outer surface 56 and reflective coating 58 shown in FIG. 2.

Light guide 74 is constructed as a solid piece which is attached to light pipe 72. In the embodiment shown, light guide 74 is formed from a transparent plastic having a fluorescent dye therein. For example, Albis Deep Red #1263 R LISA plastic (acrylic or polycarbonate) has been found to work satisfactorily. The fluorescent dye within the plastic is selected to absorb light at the wave length of the light source and emit light in the range of spectral sensitivity of PC drum 18. In the embodiment shown in FIGS. 4 and 5, light guide 74 is formed from a plastic which absorbs light at a wavelength of between 370 to 550 nM and emits light at approximately 650 nM. As the fluorescent dye absorbs and re-emits the scattered light in all directions, uniformity of emission is increased as compared to the hollow pre-transfer erase assembly 26 shown in FIGS. 1–3. Light guide 74 includes a light emitting outlet 80 having a predetermined convex shape (i.e., a lens) to direct light against PC drum 18 with a predetermined pattern. Light guide 74 has an outer surface 82 to which reflective coating 78 is applied. Reflective coating 78 on outer surface 82 eliminates loss of light associated with (e.g., toner) contamination of outer surface 82.

During use, one or more lights 50 are positioned to emit light into light pipe 72, similar to lights 50 shown in FIG. 3. In the embodiment shown in FIGS. 4 and 5, one or more yellow or green LED's are positioned at one or both ends of light pipe 72 to obtain a desired illumination intensity at PC drum 18 for effecting pre-transfer erase of PC drum 18.

Figure 6:
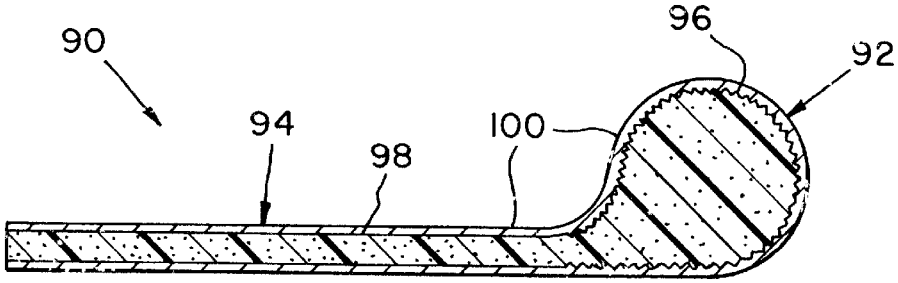
FIG. 6 is an end view of another embodiment of a monolithic light pipe and light guide of the present invention.

FIG. 6 illustrates another embodiment of a pre-transfer erase assembly 90 of the present invention. Pre-transfer erase assembly 90 includes a light pipe 92 and a light guide 94 which are formed together as a solid, monolithic body. Light pipe 92 includes a roughened outer surface 96 and light guide 94 includes an outer surface 98, each of which are coated by a reflective coating 100. In the embodiment shown, each of light pipe 92 and light guide 94 are formed from Albis Deep Red #1263 R LISA transparent plastic (acrylic or polycarbonate) with a fluorescent dye therein. One or more lights 50, preferably in the form of yellow or green LED's, with a suitable illumination intensity are placed at one or both ends of light pipe 92 for illumination of PC drum 18.

Figure 7:
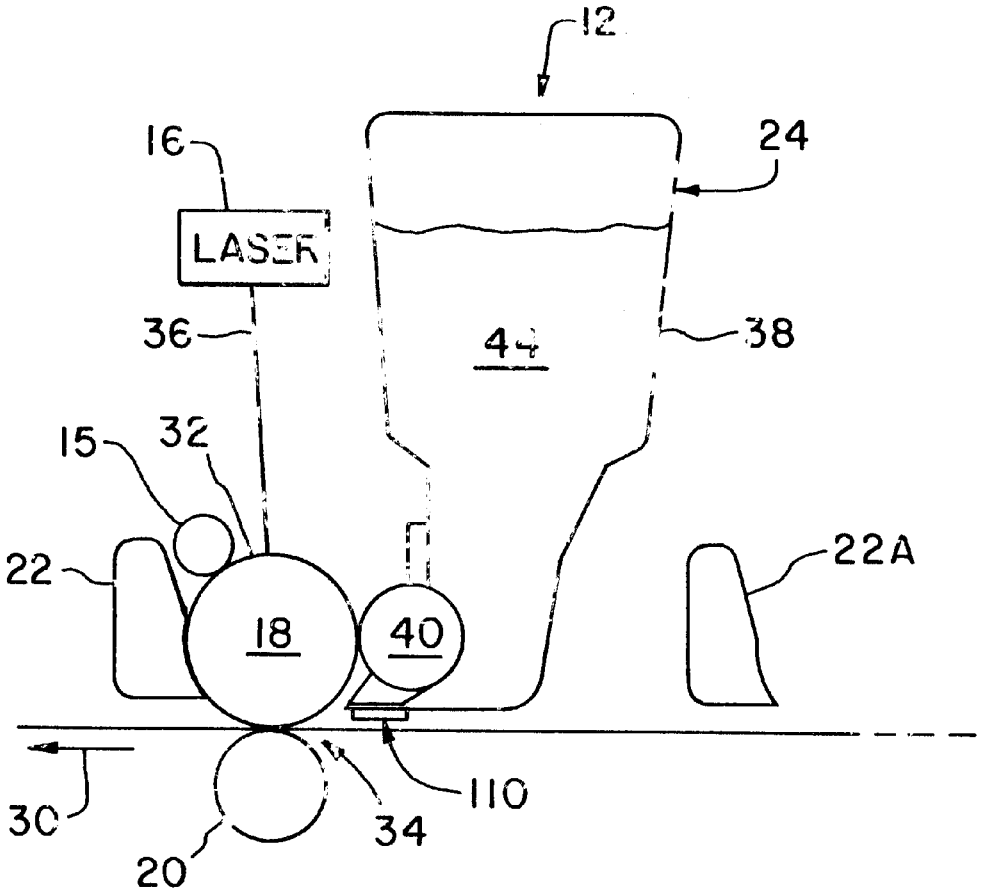
FIG. 7 is a simplified, side view of yet another embodiment of an electrophotographic imaging apparatus of the present invention.
Figure 8:
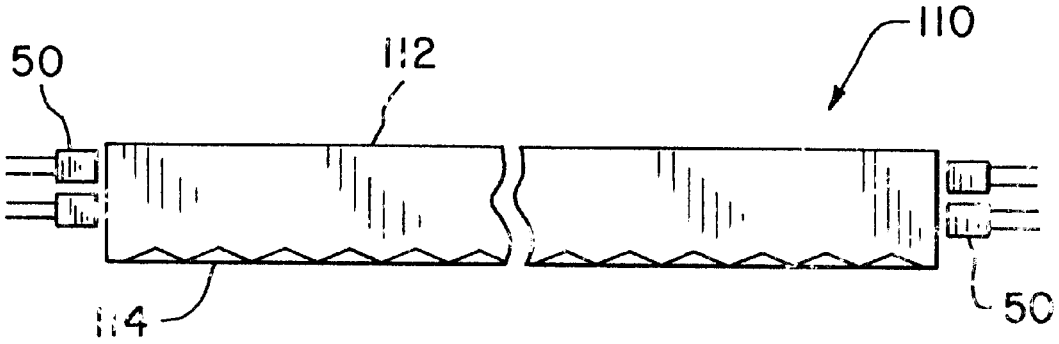
FIG. 8 is a top view of the light guide shown in FIG. 7.

Referring now to FIGS. 7 and 8, another embodiment of a pre-transfer erase assembly 110 of the present invention is shown. Pre-transfer erase assembly 110 may be advantageously utilized where space requirements limit the use of a light pipe at the rear of housing 38 of toner cartridge assembly 24. Pre-transfer erase assembly 110 is constructed from a plastic having a fluorescent dye therein, such as the Albis Deep Red #1263 R LISA plastic described above with reference to the embodiment shown in FIGS. 4–6. Pre-transfer erase assembly 110 basically consists of a light guide 112 without an attached light pipe. Light guide 112 may include a roughened outer surface, and optionally may also include a reflective coating thereon. Light guide 112 includes an outlet in the form of a light scattering surface 114 opposite the emitting surface which is configured to produce relatively uniform illumination at PC drum 18. In the embodiment shown, light scattering surface 114 has a serrated edge as shown. One or more lights 50 are positioned at one or both ends of light guide 112 to achieve a desired illumination intensity at PC drum 18. In the embodiment shown, four lights 50 in the form of yellow or green LED's which emit light at a wavelength of between 370 to 550 nM are utilized. The fluorescent dye within light guide 112 emits light in the range of the spectral sensitivity of PC drum 18 (e.g., at a wavelength of approximately 650 nM).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrophotographic image forming apparatus, comprising:

a photoconductive drum;

a transfer roll positioned adjacent to said drum, said transfer roll and said drum defining a nip therebetween lying within a substrate path;

a toner cartridge assembly positioned in association with said drum, said substrate path extending beneath said cartridge assembly; and a pre-transfer erase assembly having a light emitting outlet positioned beneath said toner cartridge assembly and overlying a portion of said substrate path, said outlet being directed toward said drum.

2. The electrophotographic image forming apparatus of claim 1, wherein said pre-transfer erase assembly comprises a light guide positioned at least partially between said toner cartridge assembly and said substrate path, said light guide including said outlet.

3. The electrophotographic image forming apparatus of claim 2, wherein said light guide is substantially plate-shaped.

4. The electrophotographic image forming apparatus of claim 3, wherein said light guide is hollow and said outlet comprises a slot-shaped outlet opening.

5. The electrophotographic image forming apparatus of claim 3, wherein said light guide is solid.

6. The electrophotographic image forming apparatus of claim 5, wherein said light guide includes a fluorescent dye therein.

7. The electrophotographic image forming apparatus of claim 5, wherein said light guide includes an outer surface with a reflective coating on at least a portion thereof.

8. The electrophotographic image forming apparatus of claim 7, wherein said reflective coating comprises reflective paint.

9. The electrophotographic image forming apparatus of claim 3, wherein said outlet is positioned at a predetermined angle relative to said drum.

10. The electrophotographic image forming apparatus of claim 2, wherein said pre-transfer erase assembly comprises a light pipe, said light guide attached to and extending from said light pipe.

11. The electrophotographic image forming apparatus of claim 10, wherein said light pipe is disposed adjacent to said toner cartridge assembly and above said substrate path.

12. The electrophotographic image forming apparatus of claim 10, wherein said light pipe is substantially cylindrical.

13. The electrophotographic image forming apparatus of claim 10, wherein said light pipe is hollow.

14. The electrophotographic image forming apparatus of claim 13, wherein said light pipe has an outer surface which is one of roughened and textured.

15. The electrophotographic image forming apparatus of claim 13, wherein said light pipe has an outer surface with a reflective coating on at least a portion thereof.

16. The electrophotographic image forming apparatus of claim 15, wherein said reflective coating comprises reflective paint.

17. The electrophotographic image forming apparatus of claim 10, wherein said light pipe is solid.

18. The electrophotographic image forming apparatus of claim 17, wherein said light pipe has a fluorescent dye therein.

19. The electrophotographic image forming apparatus of claim 1, further comprising an image substrate traveling through said nip along said substrate path.

20. The electrophotographic image forming apparatus of claim 19, wherein said image substrate comprises one of an intermediate transfer belt and a print medium.

21. The electrophotographic image forming apparatus of claim 20, wherein said image substrate comprises an intermediate transfer belt.

22. The electrophotographic imaging apparatus of claim 10, further comprising a frame, wherein said pre-transfer erase assembly includes a light guide positioned at least partially between said toner cartridge assembly and said substrate, and a light source, said light guide being attached to and carried by said toner cartridge assembly and said light source being attached to and carried by said frame.

23. An electrophotographic image forming apparatus, comprising:

a photoconductive drum;

a transfer roll positioned adjacent to and defining a nip with said drum;

an image substrate traveling through said nip in an advance direction;

a toner cartridge assembly positioned in association with said drum and above said image substrate, said substrate traveling beneath said toner cartridge assembly; and a pre-transfer erase assembly having a light emitting outlet positioned beneath said toner cartridge assembly and said image substrate traveling beneath said outlet, said outlet being directed toward said drum.

24. The electrophotographic imaging apparatus of claim 23, further comprising a frame, wherein said pre-transfer erase assembly includes a light guide positioned at least partially between said toner cartridge assembly and said substrate, and a light source, said light guide being attached to and carried by said toner cartridge assembly and said light source being attached to and carried by said frame.

25. An electrophotographic image forming apparatus, comprising:

a photoconductive drum;

a transfer roll positioned adjacent to and defining a nip with said drum;

an image substrate traveling through said nip in an advance direction;

a toner cartridge assembly positioned in association with said drum and above said image substrate, said substrate traveling beneath said toner cartridge assembly; and a pre-transfer erase assembly including a light pipe and a plate-shaped light guide, said light guide attached to and extending from said light pipe, each of said light pipe and said light guide being hollow, said light guide having a slot-shaped light emitting outlet opening positioned between said toner cartridge assembly and said image substrate, said outlet being beneath said toner cartridge assembly and directed toward said drum and said substrate traveling beneath said outlet.

26. The electrophotographic imaging apparatus of claim 25, further comprising a frame, wherein said pre-transfer erase assembly includes a light guide positioned at least partially between said toner cartridge assembly and said substrate, and a light source, said light guide being attached to and carried by said toner cartridge assembly and said light source being attached to and carried by said frame.

* * * * *